United States Patent [19]

Appelt

[11] 4,197,617

[45] Apr. 15, 1980

[54] BUTTON

[75] Inventor: Horst G. Appelt, Wuppertal, Fed. Rep. of Germany

[73] Assignee: Firma Schaeffer-Homberg GmbH, Wuppertal, Fed. Rep. of Germany

[21] Appl. No.: 913,190

[22] Filed: Jun. 6, 1978

[30] Foreign Application Priority Data

Jun. 8, 1977 [DE] Fed. Rep. of Germany ..... 2725902

[51] Int. Cl.[2] ..... A44B 1/42

[52] U.S. Cl. ..... 24/90 R; 24/95; 24/220

[58] Field of Search ..... 24/216, 95, 96, 220, 24/90 R; 85/39, 37, 72

[56] References Cited

U.S. PATENT DOCUMENTS

| | | | |
|---|---|---|---|
| 358,225 | 2/1887 | Sibley | 24/96 |
| 377,768 | 2/1888 | Noyes | 24/95 |
| 446,139 | 2/1891 | Richardson | 24/216 |
| 485,111 | 10/1892 | Nester | 24/95 |
| 508,604 | 11/1893 | Dowse | 24/216 |
| 663,521 | 12/1900 | Bunyea | 24/95 |
| 714,072 | 11/1902 | Washburne | 24/216 |
| 1,376,765 | 5/1921 | Harvey | 24/220 |
| 2,466,013 | 4/1949 | Eaton | 85/72 |
| 2,569,048 | 9/1951 | Friedman | 24/95 |
| 2,724,162 | 11/1955 | Fenton | 24/216 |
| 3,487,745 | 1/1970 | Brunelle | 85/72 |
| 4,033,012 | 7/1977 | Kramer | 24/95 |

FOREIGN PATENT DOCUMENTS

| | | | |
|---|---|---|---|
| 473136 | 12/1914 | France | 24/95 |
| 412439 | 11/1966 | Switzerland . | |

*Primary Examiner*—James T. McCall
*Attorney, Agent, or Firm*—Martin A. Farber

[57] ABSTRACT

A button or the like to be joined in one-point - fastening having two parts lying on both sides of the carrier material, the two parts to be connected to one another. One of the button parts has a hollow shaft, the pointed front end section of which is off-set with respect to the rearward shaft section by means of nominal breaking positions.

7 Claims, 7 Drawing Figures

Figure 2:
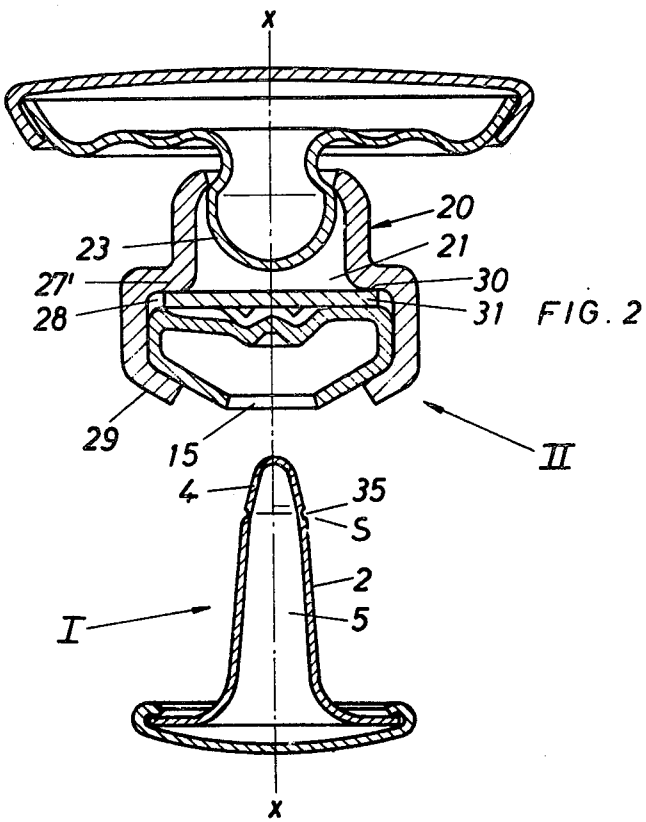

II
20
21
30
31
35
S
2
5
x
x
15
4
23
27'
28
29
I

32
II
26
20
27
21
30
27
1'
1
33
24
x
x
S
E
2
5
3
6
9
11
15
8
13
4
34
25
23
22
27'
28
29
I

BUTTON

The invention relates to a button or the like to be joined in one-point-fastening with two parts lying on both sides in the carrier material, which parts are to be connected one under the other.

Such a one-point-fastening is known by Swiss patent CH-PS 412 439. The centrally disposed plug-in mandrel which is tapered to a point on its free end extends rearwardly of a base plate of one of the button parts. After piercing through the carrier material, the other button part, which is formed in the shape of a counter plate, is set on the self-supporting freely-standing end section of the plug-in mandrel. Here a stick-in catch connection occurs for use. For this purpose the counter plate is formed housing-like and has two clamping jaws or cheeks which stand under spring biasing, which clamping jaws lockingly catch into an annular groove provided on the plug-in mandrel. This construction form is too costly for a typical mass produced article, which preferably should be coordinated in the manner of an automatic one-point-fastening. The plug-in mandrel must be formed as a precision part, particularly as a pivoted or swivel part, at least in the range of the groove which cooperates with the tensioned clamping jaws. Moreover the catch means does not permit a loading-stable assembly of the button, since the plug-in mandrel, also unintentionally by a cross displacement, can arrive in a larger opening, which opening facilitates the separation of the counter plate.

It is an object of the invention, particularly i.e., additionally to the objects gathered from the specification and claims to form a button of the species type such that with a production-wise technically simpler formation, its parts can be durably, rigidly anchored in a favorable manner on clothing parts with the use of conventional machines.

This object is solved with the subject matter of the invention by the features set forth in claim 1.

The dependent claims constitute advantageous further formations of the button according to the invention.

As a consequence of such formation a button of the species type which is simpler in production technique and more advantageous in use is achieved: in spite of a full tubular or compression rivet-like coupling of the button parts bringing a highly-stable anchoring, the carrier material in attractive manner is pierced by means of the still rigid point in the introductory phase of the connection, this with displacement or pushing aside of the textile stitches. First with the impact of the tip in the adjusted centering recess of the counter closure part, the latter forming practically an anvil, the point is detached as a consequence of the nominal breaking point and nominal breaking points, respectively, and indeed in a phase in which it is no longer of use for the penetration of the carrier material. The point-sided face edge now a tubular open free end position of the remaining rearward shaft section which becomes free is now expanded compression rivet-like as a result of the roll flanks surrounding the central recess and is guided and rolled-in outwardly to the degree of the compression stroke that is utilized. In this manner the roll flanks continue into a roll-in channel, for this comprising a sufficient support or accommodation space. The roll-in channel terminates with a roof-shaped extending cover, on which cover the rolled-in ends can be supported without again entering in the carrier material. This slightly conically roof-shaped running cover circumscribes the central entrance hole for the hollow shaft. This entrance hole can be dimensioned such that after coordination of the hollow shaft, the roll-in channel is practically hermetically sealed. In order for the self-rolling-in shaft sections not to yield to or give up an accidental division or partition, the bottom zone of the counter closure part forms radially running cutting ribs. These join directly on the roll-in flanks. In this manner a uniform or constant divided anchoring rear grip is achieved. The hollow shaft itself is formed slightly conically and continues in the sharper running conical tip. The substantially cap-like point, which is held in the recess, after separation or severing-through of the nominal breaking location, enters into the hollow shaft and the hollow shaft turns over the nominal breaking position-sided cap edge, respectively. The no longer needed conical point thus not only does not constitute a hinderance, but as a consequence of an easy or light expansion, also acts as enlarged inner supports and a projected advanced or pushed forward deflection zone. The hollow shaft continues on its rearward tubular open free end portion into an outwardly directed collar. This contributes to the stabilization of the hollow shaft and moreover serves an advantageous possibility of an anchoring on the edges of a cap part which covers the cavity of the shaft. The collar simultaneously yet serves also in an advantageous manner for fastening of the hollow shaft in the lower edge range of a pot-shaped housing, which housing on its opposite end forms the bearing opening for a button upper part. In this case the counter closure part forms the other button part. The bearing opening in the pot-shaped housing can be dimensioned such that this button upper part is received therein in a freely wobbling or tilting coordination. By the high strength edge-clamping which is facilitated, then also, the pot-shaped housing, which lies completely spacially parallel to the counter closure part, itself is coordinated without wobbling or being loose, so that on all sides, the button upper part has the same tipping-angular space available for use. The pot-shaped housing can receive the counter closure part instead of the hollow shaft.

Figure 1:
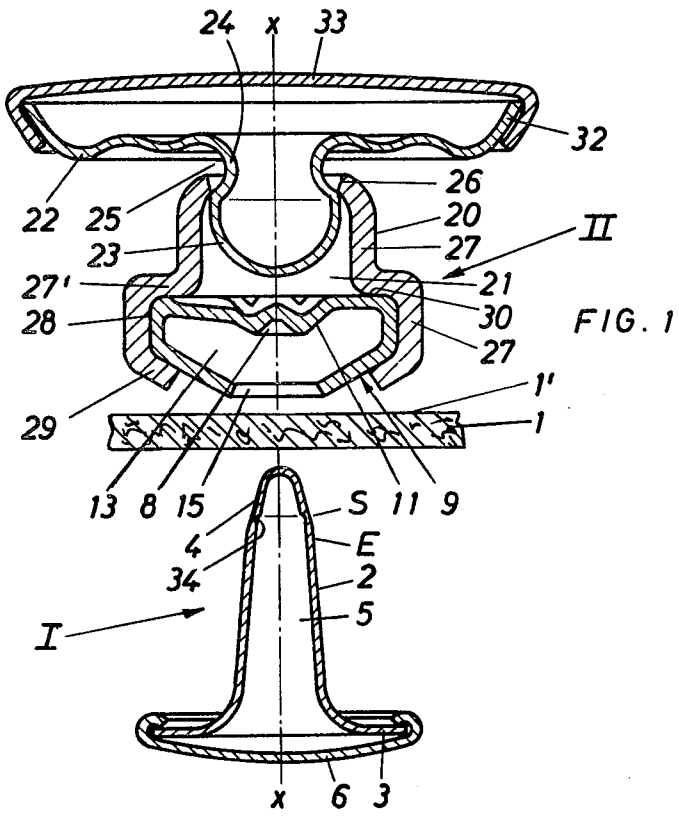
Figure 4:
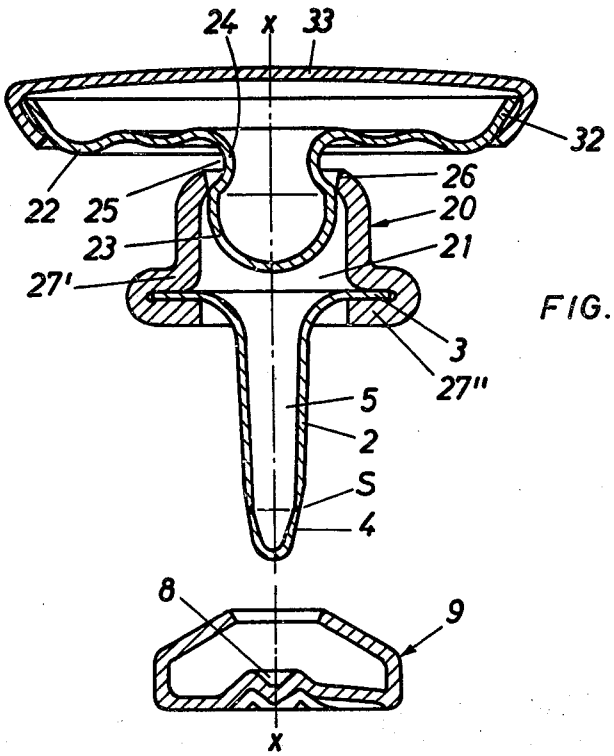
Figure 3:
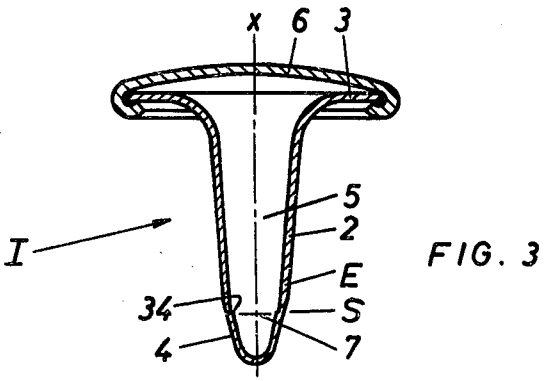
Figure 3A:
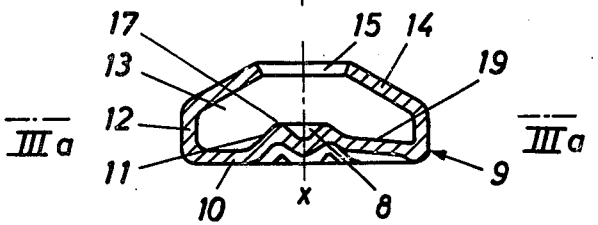
Figure 3A:
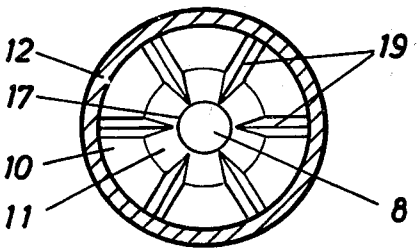
Figure 6:
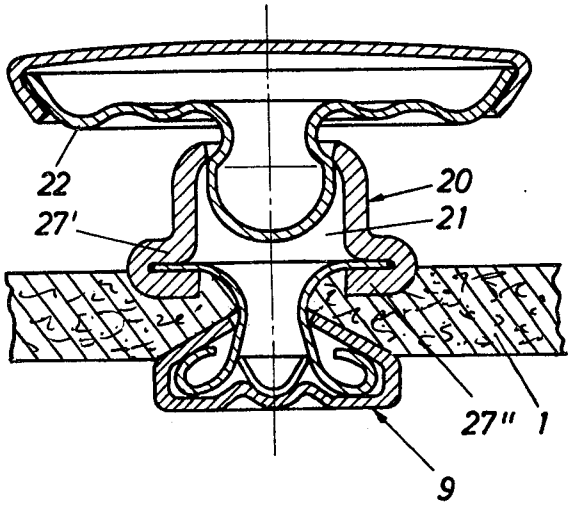
Figure 5:
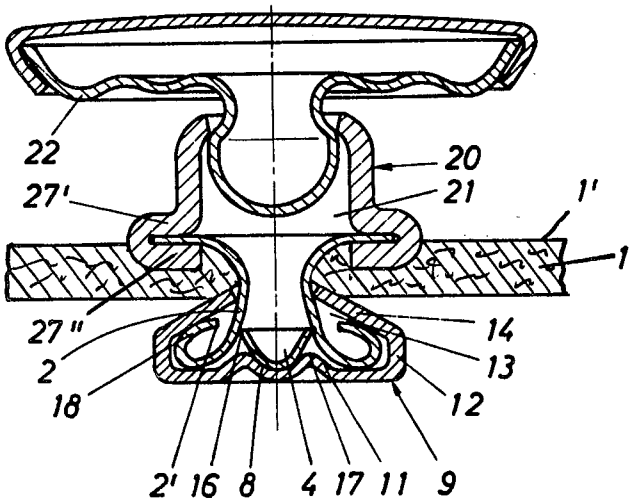

Further advantages and particulars of the subject of the invention are more closely explained in the following on the basis of an embodiment example illustrated by drawings. It shows:

FIG. 1 a button, which is to be joined in single tip-fastening, with two parts lying on both sides of the carrier material, the two parts to be connected with one another, and indeed in sectional illustration, FIG. 2 a variant thereof, FIG. 3 one of the button parts with the counter closure plate of the other button part in individual illustration, FIG. 3*a* is the section according to lines III*a*–III*a* in FIG. 3, FIG. 4 is a variant whereby a pot-shaped housing, which receives an upper part, is coordinated to one of the button parts, whereby the counter closure part forms the other button part, and FIG. 5 is a sectional view of an assembled button in accordance with the present invention, FIG. 6 is the same button fastened on a carrier part which is thicker compared to FIG. 5.

The button to be joined to unipivot or single point fastening comprises essentially two button parts I and II lying on both sides of the carrier material, which the two button parts are to be connected with one another.

The one button part I has a hollow shaft 2. This continues on one end into a collar 3 and on the other end into a point 4.

The outwardly directed collar 3 extends perpendicularly to the central axis x—x of the button. Its edge is gripped or wrapped around by a slightly arched, cover plate 6, the latter closing the shaft cavity 5.

The front end section of the hollow shaft 2, which end section forms the point 4, is plainly set-off over a nominal or desired breaking portion S with respect to the rearward shaft section. The nominal breaking point can be realized in the form of a wall narrowing down in the plane 7. The outer end of the end section which forms the tip 4 is formed dome-like. The dome zone continues into a conically shaped wall section, which, with formation of a bend zone in the vicinity of the nominal breaking location S, passes into the slightly conically shaped section of the shaft 2. The conical widening lies in the direction of the collar 3.

The tip of the point 4 enters into a substantially form-adjusted or complementary central recess 8 of a counter closure part 9 of the other button part II. The recess is obtained by means of an annular-stamping or impression in the vicinity of the bottom zone 10. In addition to or near this central recess 8 simultaneously thereby, so-called roll flanks 11 are obtained. The latter run directed outwardly and inclined relative to the bottom zone 10. The latter continues into a short annular wall 12, onto which there is joined a roof-shaped extending cover 14 which forms a roll-in channel 13, the cover 14 running inclined relative to the central axis x—x of the button. The cover 14 extends substantially parallel to the roll flanks 11.

A central entrance opening 15 for the entrance of the hollow shaft 2 of one of the button parts I is left open in the cover 14.

For assembly or mounting of the button parts I and II which lie on both sides of the carrier material 1, there are brought into the facing or opposite position evident from FIG. 1. The hollow shaft 2 of one of the button parts I penetrates the carrier material 1, the hollow shaft 2 being fed or supplied over non-illustrated means of mounting automatic units, without however damaging the textile making or the like by means of the point 4 and the tip of the point enters on the centrally disposed recess 8 of the cap closure part 9 of the other button part. With further driving-in of the button part I, the thin-walled connection zone between the point 4 and the hollow shaft 2 tears or breaks through forming a tubular open free end portion of the rearward shaft section. The conical wall of the point which lies only half-way in the recess 8 thereby drives the connection zone forming the nominal break location S between the rearward shaft section and the point outwardly and directs the now torn-off or broken-off front wall 2' of the hollow shaft 2 on the roll flanks 11, the latter lying concentric to the recess 8. By further inward displacement of the shaft 2, the tubular open free end portion E of the shaft 2 there is widened or expanded in a compression rivet-like manner in the roll-in channel 13 (compare FIG. 4). The cover 14 forms a guide surface, again inwardly turning the end zone around.

The cap-shaped tip 4 remains in the recess 8. By the expansion of the cap-edge 16, it simultaneously forms an annular shaped support- and spreading surface, which even yet projects with respect to the crest 17 of the flanks.

In order to obtain tongues 18 of equal size during the spreading of the end zone, the bottom zone 10 of the counter closure part 9 forms radially extending cutter ribs 19. These cutter ribs 19 already join or connect in the annular crest zone 17 of the roll flanks 11, so that the division or partition into individual tongues is already started immediately at the beginning of the widening of the end zone. During the stamping of the recess 8, the cutter ribs are likewise considered. The angular spacing of the individual cutter ribs with respect to one another amounts to 60° with the embodiment example. The cutter ribs end shortly in front of the annular wall 12 of the counter closure part 9 and indeed at the level or height of the bottom zone 10.

With the embodiment example according to FIGS. 1 and 2, the counter closure part 9 is coordinated to a pot-shaped housing 20. The latter forms the base or foot part for a button upper part 22, the latter being mounted tiltingly moveable, the foot part forming the bearing opening 21. The button upper part 22 has a centrally disposed hollow stay 24 which continues into a ball head 23. The hollow stay is drawn or pulled-in channel-shaped. The upper pot-edge 26 which is cross sectionally tapered or reduced with respect to the bearing opening 21 engages in the corresponding annular channel 25.

The central range of the pot-shaped housing 20 forms a cap edge 27'. The latter continues, with off-setting of the pot-wall 27, into a reception space 28 for the counter closure part 9. The free edge zone 29 of the pot-wall 27 is pulled or drawn over the cover 14 of the counter closure part 9, the edge zone 29 being stressed or clamped against the carrier material surface 1' in assembled condition.

The bottom zone 10 is reinforced by a plate 31 supporting on the inner shoulder 30, the latter being obtained by means of the off-setting of the wall.

According to the embodiment example according to FIGS. 5 and 6, however the button part I is connected with the pot-shaped housing 20. The outwardly directed collar 3 there is overlapped or extended over by the somewhat shortened pot-wall section 27''. Here the counter closure part 9 assumes the function of the button part I. The carrier material 1 is clamped or fastened between this counter closure part 9 and the lower edge of the pot-shaped housing, the lower edge being formed now by the section 27'/27''. The degree of clamping, under consideration of the different thicknesses of the carrier material, may be precisely controlled or set by means of an adjusted pressing or compression stroke.

The edge 29 and 27'', respectively, is pressed into the carrier material surface 1'. The clamping or gripping counter surface, formed by the collar 3 of the button part I or the cover 14 of the counter closure part 9, presses correspondingly into the carrier material 1.

The hollow button part 22 is closed by a cover plate 33, the latter encompassing or gripping around its edge 32 which is formed inclined rising outwardly.

For achieving the nominal breaking position, the button part I according to FIG. 1, forms an inside located annular groove 34 which weakens the wall there, which annular groove in FIG. 2 constitutes a corresponding outer groove 35.

I claim:

1. A button or the like to be joined in one-point - fastening with two parts lying on both sides of the carrier material, comprising a first button part and a second button part formed with cooperating means for connecting said button parts to one another, one of said button parts is formed with a hollow shaft having a front end section and a rearward shaft section, said front end section being formed as a point, the second button part being a hollow counter closure part having roll flank means, and nominal breaking position means for detaching said front end section from said rearward shaft section when said hollow shaft is inserted in the second button part upon an impact on said point, forming a tubular open free end portion of said rearward shaft section constituting a hollow rivet as part of said cooperating means for connecting said button parts to one another, the breaking position means being a breakable weakened portion substantially encircling the shaft between the front end section and the rearward shaft section.

2. The button according to claim 1, wherein the counter closure part is formed with a central recess and said roll flank means substantially annularly surrounding the latter, said central recess is complementary to a tip of said point, said tip of said point complementarily enters in said central recess, said roll flank means for rolling said open free end portion of said rearward shaft section of said hollow shaft annularly outwardly in said counter closure part.

3. The button according to claim 2, wherein said counter closure part is formed with a roll-in channel means for further rearwardly rolling the annularly outwardly rolled open free end portion of said rearward shaft section and with a roof-shaped extending cover, said roll-in channel means joins said roll flank means, said cover forms a central entrance opening, said hollow shaft extends through said central entrance opening in a connecting condition of said button parts.

4. A button or the like to be joined in one-point - fastening with two parts lying on both sides of the carrier material, comprising a first button part and a second button part formed with cooperating means for connecting said button parts to one another, one of said button parts is formed with a hollow shaft having a front end section and a rearward shaft section, said front end section being formed as a point, nominal breaking position means for detaching said front end section from said rearward shaft section, the breaking position means being a breakable weakened portion substantially encircling the shaft between the front end section and the rearward shaft section, the other of said button parts being a hollow counter closure part formed with a central recess and roll flanks means surrounding the latter, said central recess is adjusted to the shape of said point, said point enters in said central recess, said roll flanks means for rolling said rearward shaft section of said hollow shaft in said counter closure part, said counter closure part has a bottom zone having cutter ribs formed thereon, said cutter ribs extend radially and join on the roll flanks means.

5. The button according to claim 1, wherein said rearward shaft section of said hollow shaft is formed slightly conically with said point extending conically sharper.

6. The button according to claim 2, further comprising an outwardly directed collar continues into a rearward end of said rearward shaft section of said hollow shaft, a pot-shaped housing defining a reception space and having a lower edge adjacent one side of the carrier material, said counter closure part is complementarily disposed in said reception space, said collar operatively braces said lower edge and acts against the opposite side of the carrier material in an assembled condition, said pot-shaped housing has a housing end opposite said lower edge, said housing end forms a bearing opening, a button upper part is moveably mounted in said bearing opening.

7. The button according to claim 2, wherein said nominal breaking position means constitutes weakened wall portions of said hollow shaft for severing said point from said rearward shaft section during connection of said button parts, said point being held in said central recess and constituting deflection means for guiding said rearward shaft section outwardly, said point being located inside said rearward shaft section.

* * * * *